US005622523A

United States Patent [19]

Kan et al.

[11] Patent Number: 5,622,523

[45] Date of Patent: Apr. 22, 1997

[54] GROUNDING DEVICE FOR USE WITH SHIELDED DIN CONNECTOR

[75] Inventors: Ko-Chien Kan, Taipei, Taiwan; Qisheng Zheng, Kun-Shan, China

[73] Assignee: Hon Hai Precision Ind, Co., Ltd., Taiwan

[21] Appl. No.: 550,786

[22] Filed: Oct. 31, 1995

[51] Int. Cl.[6] ..... H01R 13/648

[52] U.S. Cl. ..... 439/607; 439/939

[58] Field of Search ..... 439/92, 95, 96, 439/108, 607, 609, 939

[56] References Cited

U.S. PATENT DOCUMENTS

| | | | |
|---|---|---|---|
| 5,022,871 | 6/1991 | Sekiguchi | 439/609 |
| 5,178,562 | 1/1993 | Ermini | 439/939 X |
| 5,288,248 | 2/1994 | Chen | 439/609 |
| 5,326,280 | 7/1994 | Briones et al. | 439/939 X |

*Primary Examiner*—Khiem Nguyen

[57] ABSTRACT

An electrical connector (12) includes an insulative housing (16) surrounded by conductive shield means (18, 20) and adapted to be mounted on a PC board (100). A mating portion (37) extends inward from a front surface (38) of the housing (16) which is covered by the shield (18, 20). A plurality of contacts (40) are disposed in the mating portion (37) and extend rearward for connecting to the PC board (100). The shield (18, 20) includes an opening (42)in its front face (22) for having a complementary plug connector inserted into the mating portion (37) of the housing (16). A grounding device (14) comprises a plate (50) having the similar configuration of the front face (22) of the shield (18), and engagement tangs (54) projecting from a bottom edge of the plate (5[illegible]) [illegible]rward to form a bight section (56) and successiv[illegible] to form a vertical section (58). The vertical [illegible] is generally sandwiched between the front face [illegible] the shield (18) and the front surface (38) of the housing (16). A horizontal extension (60) of the grounding device (14) vertically abuts against a supporting plate or a restriction tag (23) extending rearward from the front face (22) of the shield (18) for preventing the grounding device (14) from moving downward and leaving the connector (12).

13 Claims, 6 Drawing Sheets

14

GROUNDING DEVICE FOR USE WITH SHIELDED DIN CONNECTOR

BACKGROUND OF THE INVENTION

1. Field of the Invention

The invention relates to grounding devices for use with shielded DIN connectors, particularly to the grounding plate which can be reliably retained with the corresponding DIN connector and thus be efficiently engaged with the shield of such DIN connector for ESD (Electrostatic Discharge) or EMI (Electromagnetic Interference) consideration.

2. The Prior Art

Din connectors are very popular I/O (Input/Output) components for use with the computer. For aforementioned ESD and/or EMI consideration, most recent DIN connectors are covered by the shield which optimally surrounds four side faces and a top face, except the bottom face which is directly mounted onto the PC board, of the connector housing. For a common design, a conductive path is formed between such shield and the below PC board for removal of the undesired electrostatic charges from the shield to the grounding electrode printed on the PC board. While, sometimes a grounding device which is designedly connected between the shield of the DIN connector and the backpanel of the computer wherein such DIN connector is positioned closely disposed behind the backpanel and can mate with an external complementary plug connector via an opening in the backpanel. It can be understood that the grounding device may be deemed as an auxiliary grounding means for promptly removing any improper electrostatic charges imposed on the shield of the DIN connector therefrom through the backpanel and the computer case, instead of the conventional path, i.e., through the circuits which are printed on PC board and directly connected to the grounding legs downward extending from the shield of the DIN connector.

To assure a good conduction between the shield of the DIN connector and the backpanel, such grounding device therebetween is generally required to be characterized to own sufficient resiliency for provision of desired engagement with the corresponding shield of the connector and the corresponding backpanel of the computer case. Additionally, because such grounding device is generally arranged as an optional accessory of the DIN connector and may be provided therewith if requested by the computer manufacturer, the grounding device should have a reliable retention relationship with the DIN connector for not jeopardizing its integrity with the DIN connector regardless of whether it is during delivery from the connector manufacturer to the computer manufacturer, or it has been assembled in the computer and sold to the end user. Good retention of the grounding device with regard to the DIN connector assures that the grounding device can not be dropped from the DIN connector not only during shipping from the connector manufacturer to the computer manufacturer for simplifying assembling such DIN connector associated with the corresponding grounding device to the whole computer set, but also after such DIN connector with the grounding device has been assembled to the computer whole package and used by an end user for expectation of the excellent grounding function occurring between the shield of the DIN connector and the backpanel of the computer case.

Most prior art grounding devices are as shown in FIG. 1 which uses two screws 3 extending through two corresponding holes (not shown) in the connector 1 for fastening the grounding device 2 to the connector 1 and achieving the conductive path formed between the grounding device 2 and the front shell 4 of the connector 1. Even though the retention and electrical engagement of the grounding device 2 regard to the connector are without question, the disadvantage of this type design includes (1) more components, i.e., screws, being used for implementation of assembling of the grounding device 2 and the connector 1. Therefore, a second type prior art grounding device was introduced in U.S. Pat. No. 5,288,248, which has the same assignee with the invention wherein the grounding device includes two hook sections adapted to extend around the bottom edge of the front shell of the DIN connector and further latchably project into two corresponding recesses located on two opposite front bottom corners of the housing. This configuration may eliminate using two fastening screws of the first type design, but sometimes the recesses can not securely retain the corresponding hook sections of the grounding device 2 therein. Thus, the grounding device may be easily dropped from the DIN connector during shipping from the connector manufacturer to the computer manufacturer, and the worker of the computer manufacturer needs to take more care of assembling the connector with the grounding device to the whole computer system. By the way, such questionable retention between the grounding device and the connector may introduce a poor engagement therebetween, accordingly. Then, the grounding performance of such grounding device may be diminished.

Accordingly, an object of the invention is to provide a DIN connector with a grounding device which is adapted to be not only easily attached thereto, but also securely retained thereto, thus assuring no dropping during delivery and good conductive engagement therewith for achievement of desired ESD and/or EMI consideration.

SUMMARY OF THE INVENTION

According to an aspect of the invention, an electrical connector includes an insulative housing surrounded by a conductive shield and adapted to be mounted on a PC board. A mating portion extends inward from a front surface of the housing which is covered by the shield. A plurality of contacts are disposed in the mating portion and extend rearward for connecting to the PC board. The shield includes an opening in its front face for having a complementary plug connector inserted into the mating portion. A grounding device comprises a plate having the similar configuration with the front face of the shield, and engagement tangs projecting from a bottom edge of the plate rearward to form a bight section and successively upward to form a vertical section. The vertical section is generally sandwiched between the front face of the shield and the front surface of the housing. An extension of the grounding device vertically abuts against a supporting plate extending rearward from the front face of the shield for preventing the grounding device from moving downward and leaving the connector.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
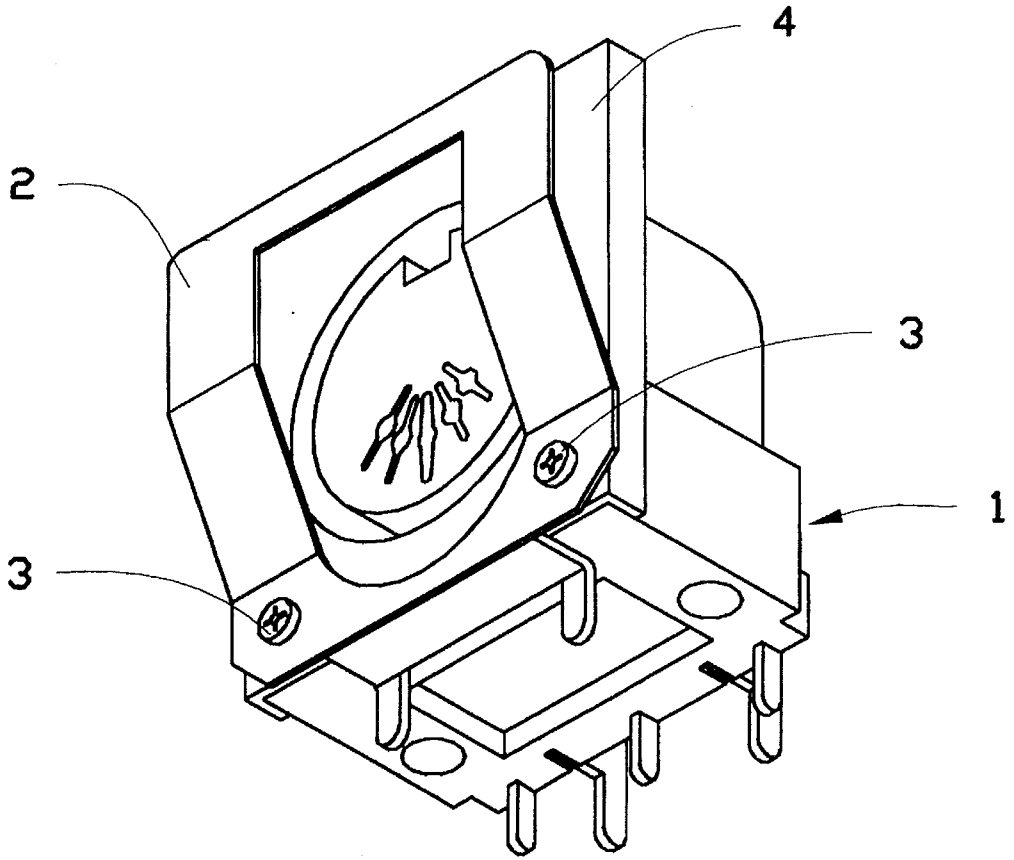
FIG.1 (PRIOR ART)
FIG. 1 is a perspective view of a prior art grounding for use with a conventional DIN connector.
Figure 2:
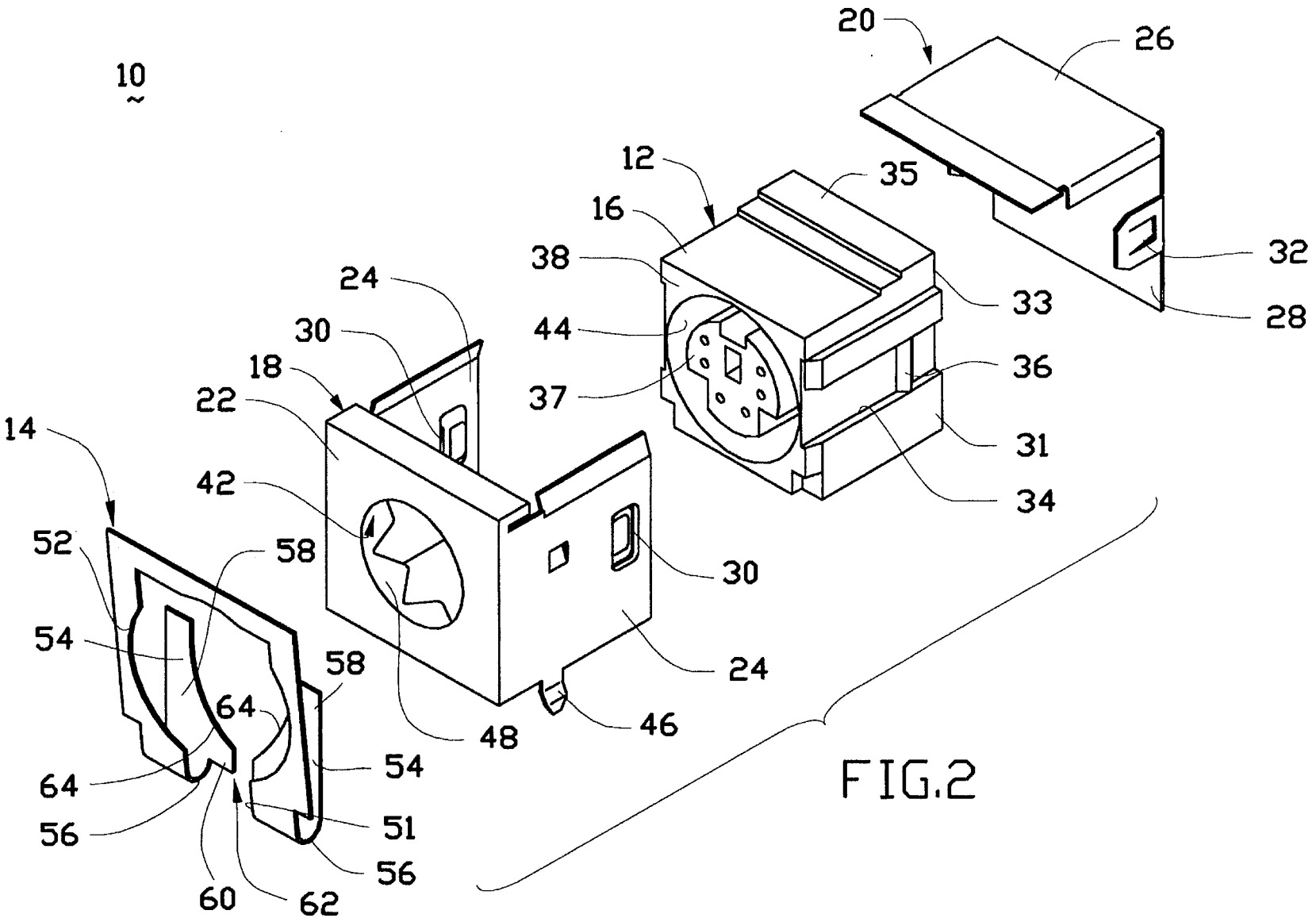
FIG. 2 is an exploded perspective view of a presently preferred embodiment of a DIN connector with a grounding device according to the invention.
Figure 3:
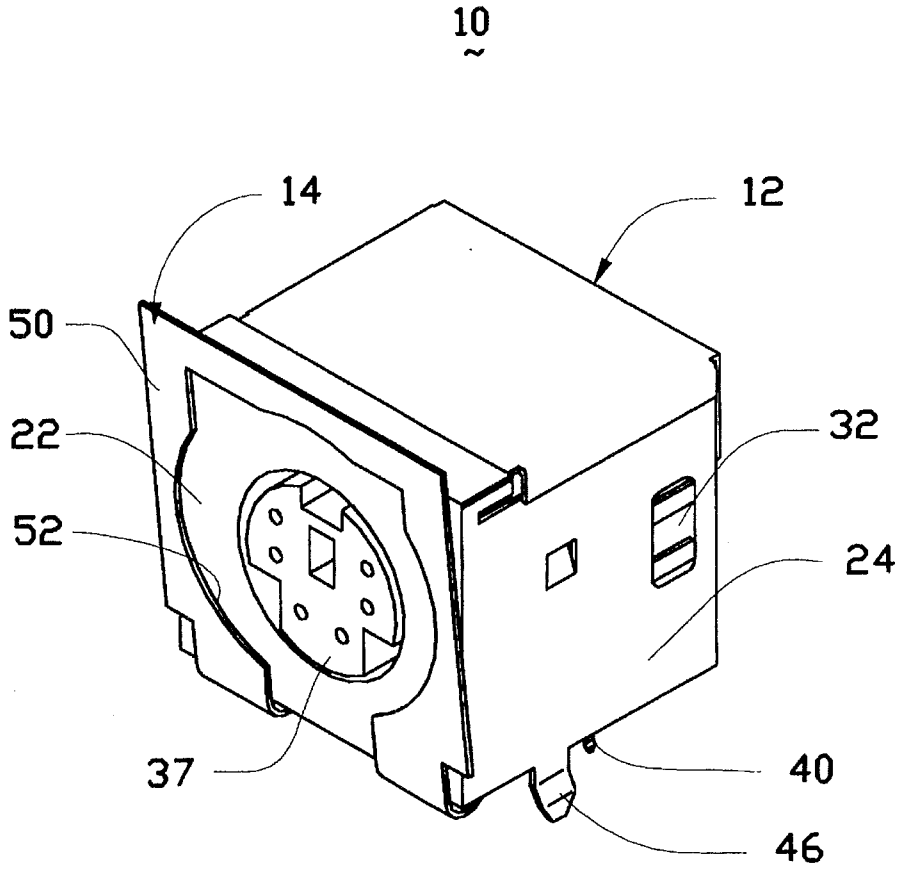
FIG. 3 is a perspective view of an assembled DIN connector associated with the grounding device of FIG. 2.
Figure 2A:
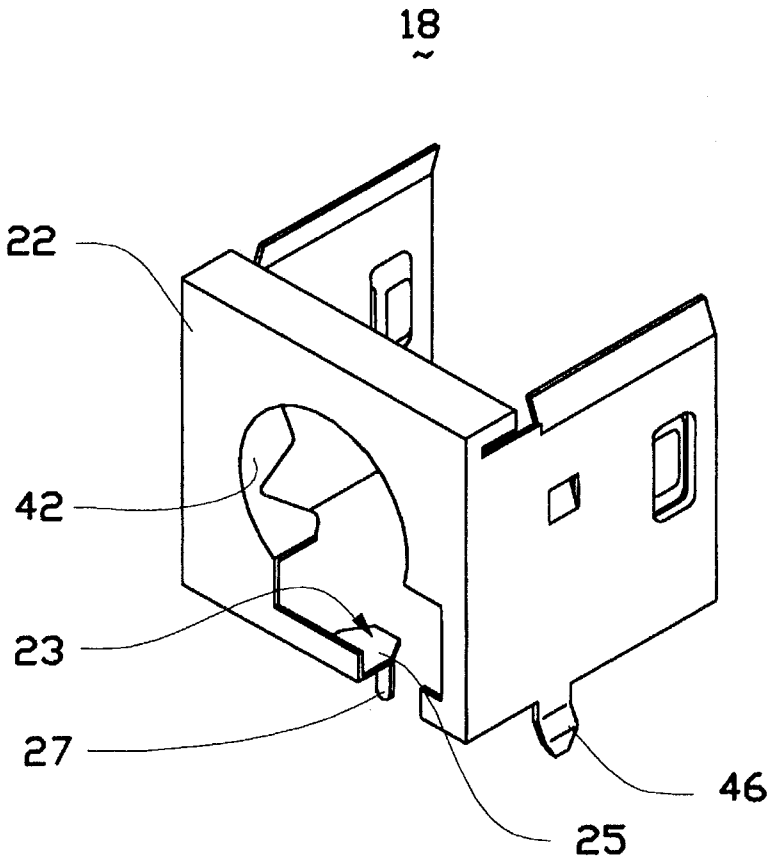
FIG. 2(A) is a fragmentary perspective view of the front shell of the DIN connector to show the restriction tag thereof which is adapted to abut against the corresponding grounding device.

It will be noted here that for a better understanding, most of like components are designated by like reference numerals throughout the various figures in the embodiments. Attention is now directed to FIGS. 2 and 3, wherein an electrical DIN connector assembly 10 includes a DIN connector 12 and a grounding device 14. The connector comprises an insulative housing 16 surrounded by shield means comprising a front metal shell 18 and a rear metal shell 20 wherein the front shell 18 includes a front face 22 and two side faces 24 for respectively shielding the corresponding front surface 38, and two side surfaces 31 (only one shown) of the housing, and the rear shell 20 includes a top face 26 and a rear face 28 for respectively shielding the corresponding top surface 35 and the rear surface 33 of the housing 16. The front shell 18 and the rear shell 20 are fastened to each other by means of the retention slit sections 30 in two side faces 24 of the front shell 18 and the locking tangs 32 (only one shown), and both of them are secured to the housing 16 by such locking tangs 32 and retention slit sections 30 received within the corresponding orientation channels 34 (only one shown) on two sides of the housing 16, and by the retention slit sections 30 engaged with the restraining bars 36 (only one shown) in the corresponding channels 34.

Figure 5:
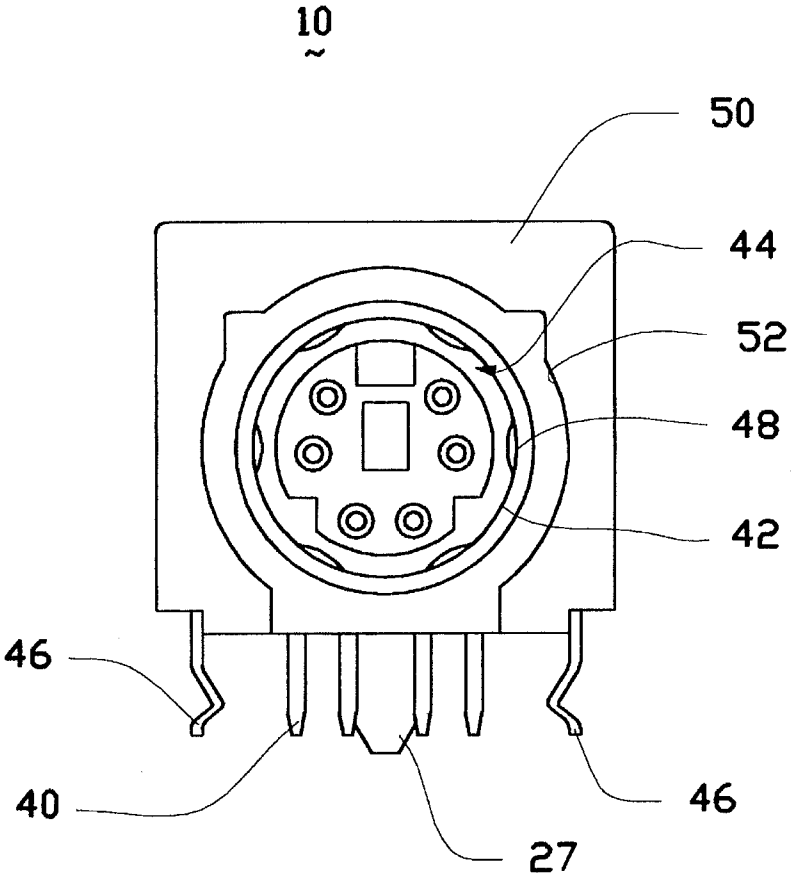
FIG. 5 is a front view of the assembled DIN connector with the grounding device of FIG. 2.
Figure 6:
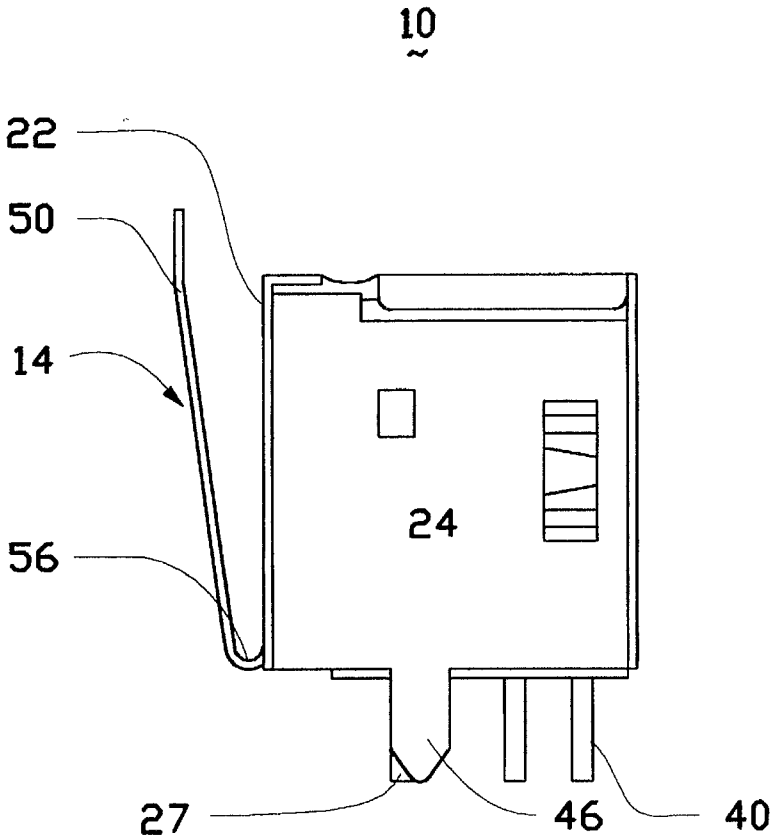
FIG. 6 is a side view of the assembled DIN connector with the grounding device of FIG. 2.

The housing 16 includes a mating portion 37 extending, which is adapted to be mated with a complementary plug connector 106 (FIG. 7), inward from a front surface 38 thereof and a plurality of contacts 40 (FIGS. 3 and 5) disposed therein wherein the tails of the contacts 40 are bent downward for being soldered to a PC board 100 (FIG. 7) on which the connector 12 is mounted.

The front face 22 of the front shell 18 includes an opening 42 in alignment with the mating portion 37 of the housing 16 wherein a plurality fingers 48 extending inward (i.e., rearward) from a periphery of the opening 42 into the tubular slot 44 in the housing 16. A pair of side grounding legs 46 extend downward from the bottom edges of the two side faces 24 of the front shell 18 for grounding on the PC board 100.

As noted, the aforementioned general structures of the connector 12 can be referred to the mentioned U.S. Pat. No. 5,288,248 ('248). Different from what is disclosed in such '248 U.S. Patent, in the present invention and also with reference to FIG. 8, the grounding device 14 includes a grounding plate 50 having an hole 52 generally in alignment with the opening 42 in the front face 22 of the front shell 18. A pair of engagement tangs 54 integrally extend from the bottom edge of the grounding plate 50 wherein each engagement tang 54 includes a bight section 56 connected to the grounding plate 50 and a vertical section 58 successively projecting from such bight section 56. Such vertical sections 58 of the engagement tangs 54 further include horizontal extensions 60 generally respectively extending from the lower portion of the vertical section 58 toward each other while a gap 62, which has a width dimension of D1, is formed therebetween. The vertical section 58 and the associated horizontal extension 60 both define a partially circular contour 64 facing inward in compliance with the corresponding opening 42 in the front face 22 of the front shell 18.

Correspondingly, referring to FIGS. 2(A) and 4–6, the front face 22 further includes a restriction tag 23 integrally extending from the bottom edge thereof wherein such tag 23 comprises a horizontal portion 25 directly horizontally projecting from the bottom edge of the front face 22, and a vertical portion 27 downward from the end of such horizontal portion 25. In this embodiment, the vertical portion 27 may function as the side grounding legs 46 of the side faces 24 for both grounding and securely mounting to the PC board 100. Specifically, the width dimension D2 of the horizontal portion 25 is substantially larger than the width dimension D1 of the gap 62 between two horizontal extensions 60 of the engagement tangs 54 of the grounding device 50.

Figure 4:
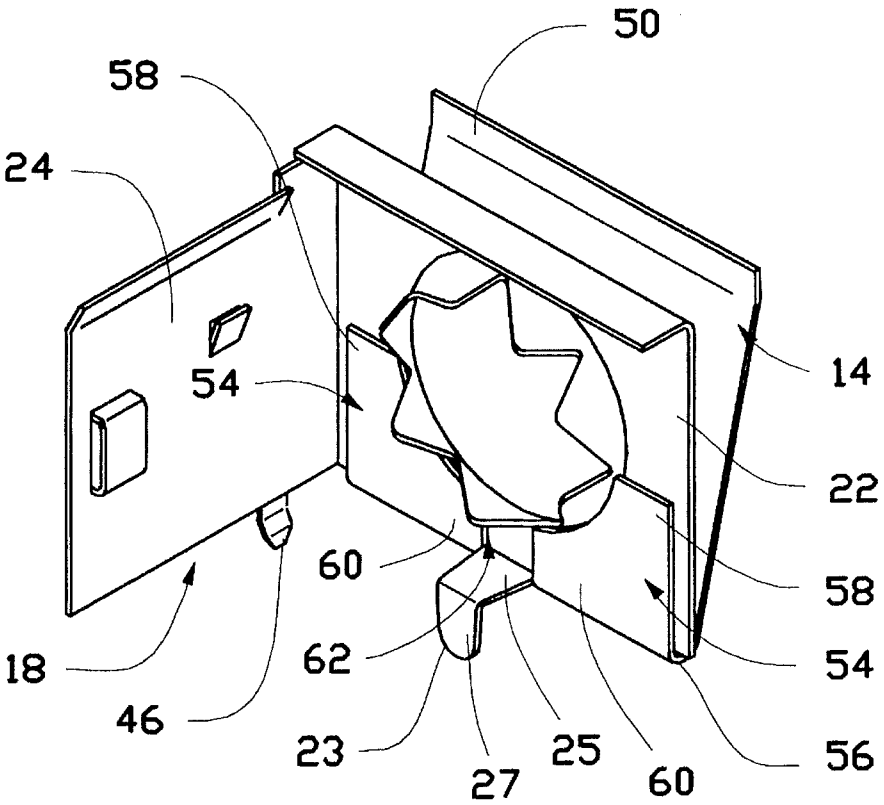
FIG. 4 is a rear perspective view of the grounding device and the corresponding front face of the shield of FIG. 2 to show the restrictive relationship therebetween wherein one side face has been removed therefrom for viewing such subject structures.
Figure 8:
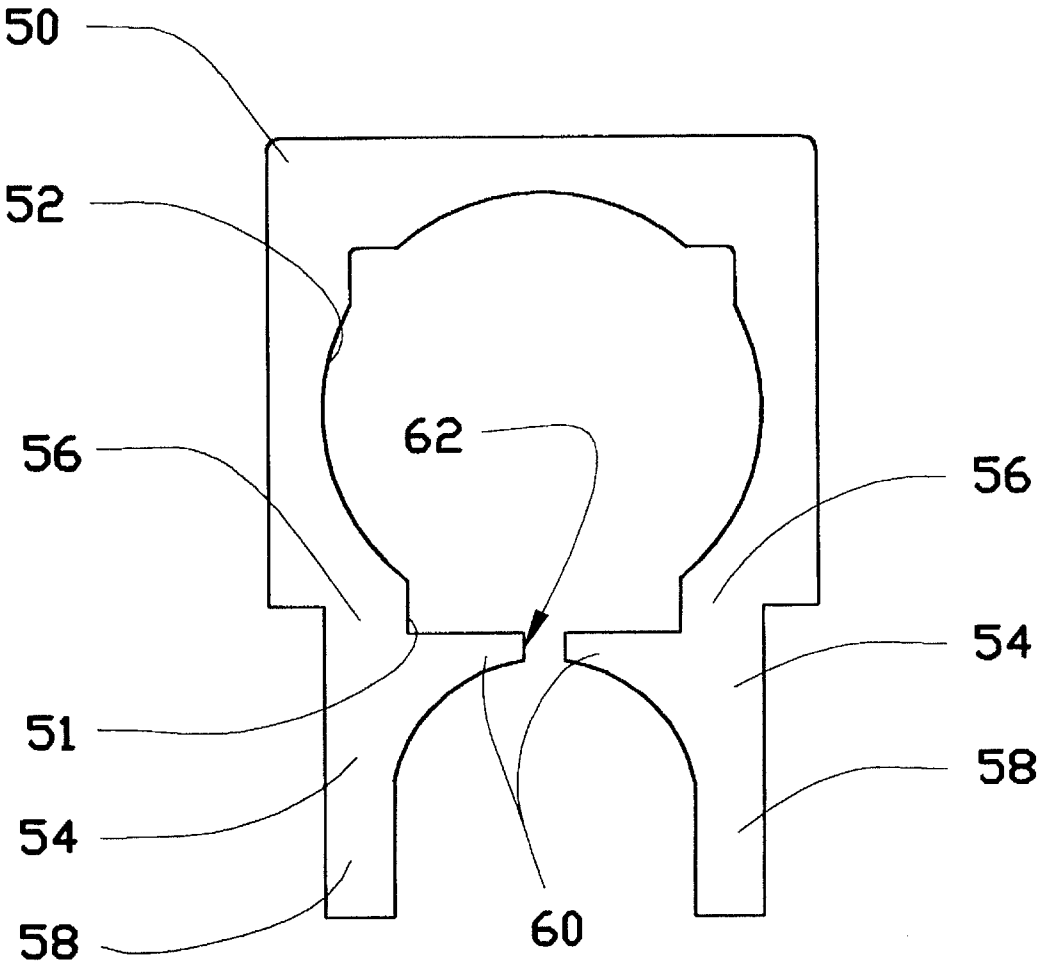
FIG. 8 is a plan view of an extended grounding device of FIG. 2 before bending and forming.

Understandably, the housing 16, the front shell 18 and the rear shell 20 can be themselves assembled together as disclosed in the aforementioned U.S. Pat. No. 5,288,248. Differently, in the invention, the grounding device 14 is designedly attached to the front shell 18 before the front shell 18 is assembled to the housing 16 or to the rear shell 20. Before the grounding device 14 has been formed from its initial plate form as shown in FIG. 8 to its final shape as shown in FIG. 2, the front shell 18 and the grounding device 14 may be preliminarily assembled to each other wherein the horizontal portion 25 is positioned within the space 51 below the hole 52 in the grounding plate 50, and then the grounding device 14 is formed or bent to its final shape to have the vertical sections 58 of its two engagement tangs 54 upward extend from the bight sections 56, as shown in FIG. 4.

Therefore, when the front shell 18 with its associated grounding device 14 is assembled to the housing 16 and the rear shell 20, the engagement tangs 54 are naturally substantially tightly sandwiched between the front face 22 of the front shell 18 and the front surface 38 of the housing 16, thus assuring conductivity/grounding performance between the front shell 18 and the engagement tangs 54. This sandwiching arrangement also provides the securement between the grounding device 14 and the connector 12 in a front-to-end direction.

Additionally, two engagement tangs 54 respectively abut against the side faces 24 of the front shell 18 and that provides a lateral securement of the grounding device 14 with regard to the connector 12 in the lateral direction. Finally, the horizontal extensions 60 of the engagement tangs 54 butts the horizontal portion 25 of the restriction tag 23 of the front shell 18, and that prohibits the grounding device 14 from vertically moving downward with regard to the connector 12. Oppositely, the bight sections 56 of the engagement tangs 54 butt the corresponding bottom edge of the front face 22 of the front shell 18, and that prohibits the grounding device 14 from vertically moving upward regard to the connector 12. Thus, the grounding device 14 is secured to the connector 12 in the vertical direction. Accordingly, the grounding device 14 is securely retained regard to the connector 12 in any of directions, thus assuring its securement to the whole assembly 10.

Figure 7:
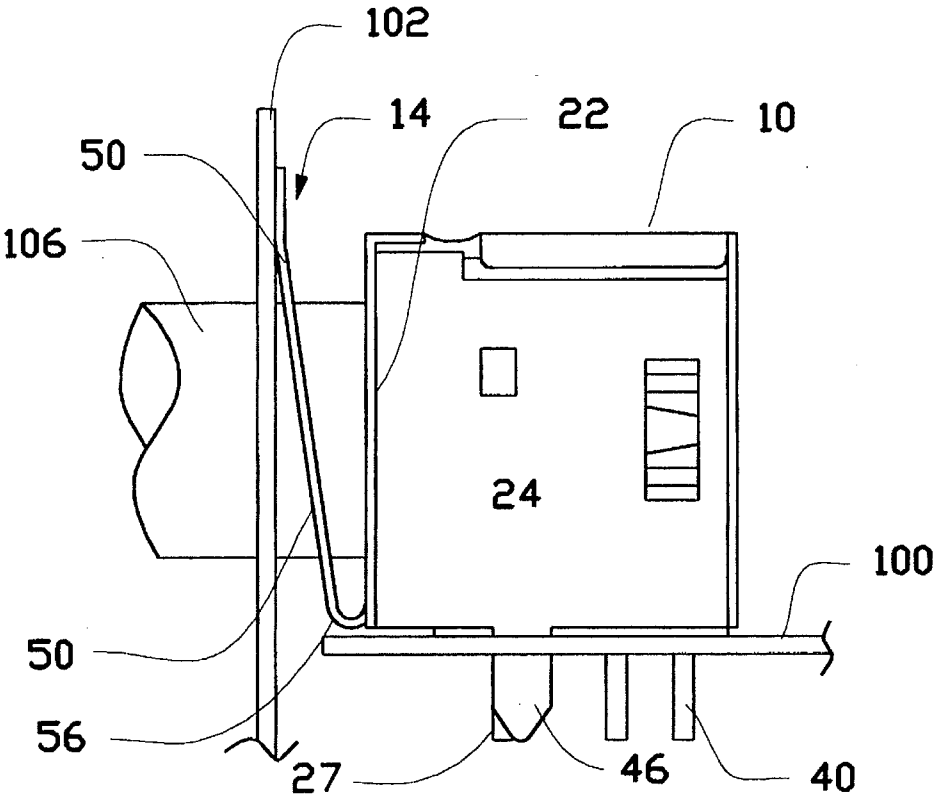
FIG. 7 is a side view of the assembled DIN connector with the grounding device of FIG. 2 wherein the connector is mounted on the PC board and the grounding device confronts the backpanel of the computer case.

The assembled DIN connector 12 with its associated grounding device 14 has a good mechanical retentive and electrical grounding relationship as shown in FIGS. 3 and 5–7 wherein in FIG. 7, and the grounding plate 50 designedly abuts against the back panel 102 of the computer case (not shown).

It can be seen that there may be at least two methods to assemble the grounding device 14 and the front shell 18 together. One is that the two engagement tangs 54 are respectively deflected outward in the opposite directions to expand the gap 62 therebetween to then have the horizontal portion 25 of the restriction tag 23 pass, and recovered to its original positions to keep the original dimension D1 of the gap 62. Alternately, the horizontal portion 25 may be directly inserted into the space 51 below the opening 52 of the ground plate 50, and then the grounding device 14 is formed to its final shape to have the horizontal extensions 60 of the engagement tangs 54 abut against the horizontal portion 25 of the restriction tag 23 of the front shell 18.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A DIN connector assembly comprising:

an insulative housing including a front surface and a mating portion extending rearward from said front surface;

a plurality of contacts positioned within said mating portion;

shield means adapted to be attached to the housing and including at least one front face for covering at least said front surface of the housing, said shield means including an opening in alignment with said mating portion;

a grounding device including a grounding plate and engagement means wherein said engagement means is sandwiched between the front surface of the housing and the front face of said shield means for restraining movement of said grounding with regard to the housing in a front-to-end direction; and restriction means formed on said shield means for latchably retaining said grounding device in position with regard to said shield means for restraining movement of said grounding device with regard to the housing in a vertical direction; wherein said engagement means of the grounding device includes a pair of engagement tangs integrally extending rearward from a bottom edge of the grounding plane, and each of said engagement tangs includes a bight section directly projecting from the grounding plate and a vertical section projecting from said bight section; and a horizontal extension further extends from the corresponding vertical section of each of said engagement tangs for engagement with the restriction means of said shield means whereby the horizontal extension of one of said engagement tangs incorporates the horizontal extension of the other of said engagement tangs to define therebetween a gap having a smaller dimension than a horizontal portion of said restriction means.

2. The assembly as defined in claim 1, wherein each extension cooperates with the corresponding vertical section of the engagement tang to define a partial circular contour in compliance with the opening said shield means.

3. The assembly as defined in claim 1, wherein said shield means includes a front shell and a rear shell fastened to each other and further to said housing, and said front face is formed on said front shell.

4. The assembly as defined in claim 1, wherein said restriction means extends from a bottom edge of said front face of said shield means.

5. The assembly as defined in claim 1, wherein said shield means further includes two side faces whereby said engagement means butts said two side faces for restraining movement of said grounding device with regard to the housing in a lateral direction.

6. A DIN connector assembly comprising:

an insulative housing including a front surface and a mating portion extending rearward from said front surface;

a plurality of contacts positioned within said mating portion;

shield means adapted to be attached to the housing and including at least a front face and restriction means integrally extending from a bottom edge thereof in a direction which is perpendicular to said front surface of the housing; and a grounding device including a grounding plate and engagement means wherein said engagement means integrally extends rearward from said grounding plate, includes at least one engagement tang substantially sandwiched between the front surface of the housing and the front face of the shield means and incorporates said restriction means of said shield means to latchably retain said grounding device to said shield means so that said grounding device can not be withdrawn from said assembly in both vertical and horizontal directions.

7. The assembly as defined in claim 6, wherein said engagement means includes a pair of engagement tangs integrally extending from a bottom edge of said grounding plate, and wherein each of said engagement tangs includes a bight section and a vertical section.

8. The assembly as defined in claim 7, wherein two horizontal extensions respectively extend from said vertical sections of said engagement tangs toward each other, and define therebetween a gap, of which the dimension is smaller than that of a horizontal portion of said restriction means, whereby said two extensions of said two engagement tangs abut against said horizontal portion of said restriction means.

9. The assembly as defined in claim 7, wherein said shield means includes a front shell and a rear shell to cover at least one surface of said housing.

10. A grounding device for use with a DIN connector which includes an insulative housing surrounded by shield means having at least one front face with an opening therein to cover a front surface on said housing, said grounding device comprising:

a grounding plate generally having a hole in alignment with said opening of said shield means; and engagement means adapted to be sandwiched between said front face of said shield and said front surface of said housing; wherein said engagement means further includes a pair of horizontal extensions projecting toward each other in a close manner and commonly defining therebetween a gap which is substantially smaller than a width defined by a restriction tag formed on said shield means.

11. The grounding device as defined in claim 10, wherein said engagement means includes a pair of engagement tangs extending from said grounding plate, and each of said engagement tangs includes a bight section and a vertical section.

12. A DIN connector assembly comprising:

a cubic insulative housing having a plurality of surfaces including a front surface from which a mating portion extends rearward;

shield means surrounding said plural surfaces except a bottom surface of said housing which faces to a PC board on which said housing is mounted;

a grounding device including a grounding portion adapted to abut against a backpanel of a computer case, and engagement means which, after assembled, is generally positioned within said shield means and includes means cooperating with restriction means extending from said shield means for preventing said grounding device from being withdrawn from said assembly in both vertical and horizontal directions.

13. The assembly as defined in claim 12, wherein said engagement means is sandwiched between one of said surfaces of the housing and one face of said shield means.

* * * * *